United States Patent [19]

Marks

[11] 4,061,170

[45] Dec. 6, 1977

[54] GLOVE CONDITIONING CONTAINER

[75] Inventor: Arnold Marks, Philadelphia, Pa.

[73] Assignees: Arnold Marks; Judith A. Marks, both of Philadelphia; Harry E. Livingston, Cheltenham, all of Pa.

[21] Appl. No.: 699,018

[22] Filed: June 23, 1976

[51] Int. Cl.[2] ..... B65D 65/02

[52] U.S. Cl. ..... 150/52 R; 206/278

[58] Field of Search ..... 150/52 R; 206/278; 402/73

[56] References Cited

U.S. PATENT DOCUMENTS

| | | | |
|---|---|---|---|
| 1,705,149 | 3/1929 | Brady | 150/52 |
| 2,329,620 | 9/1943 | Johnson | 206/278 |
| 2,604,919 | 7/1952 | Harwood | 150/52 |
| 2,674,288 | 4/1954 | Laidlaw | 150/52 |
| 2,908,308 | 10/1959 | Dearholt | 150/52 |
| 3,391,855 | 7/1968 | Ansell | 206/278 |
| 3,525,376 | 8/1970 | Muhlhauser | 150/52 |
| 3,746,152 | 7/1973 | Allen | 150/52 |

*Primary Examiner*—Ro E. Hart

*Attorney, Agent, or Firm*—J. Rodman Steele, Jr.

[57] ABSTRACT

A glove conditioning container designed particularly for conditioning gloves used for various sports such as golf and handball. The subject container comprises a foldable type member which includes means for separating gloves contained therein and further includes means for permitting a controlled amount of air to reach the gloves while stored therein.

11 Claims, 7 Drawing Figures

FIG. 6
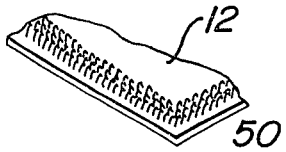
FIG. 1
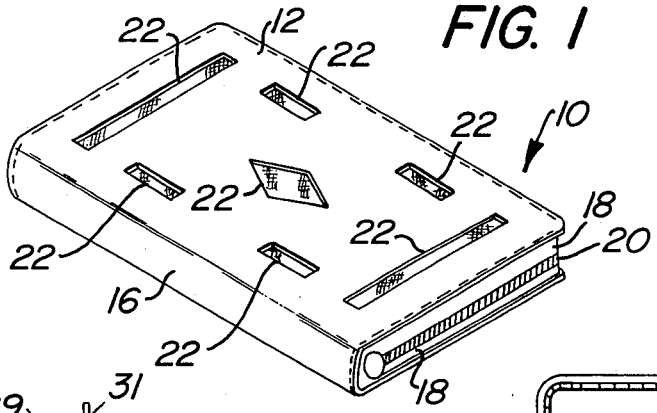
FIG. 2
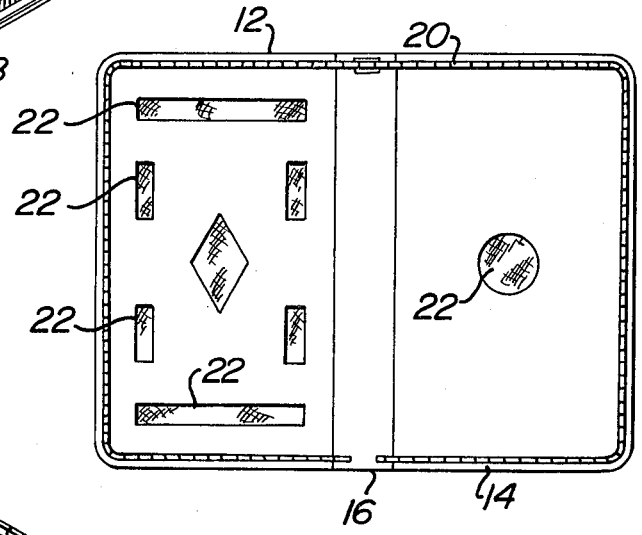
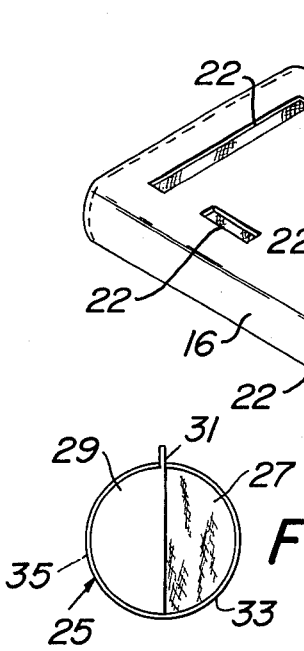
FIG. 3A
FIG. 3
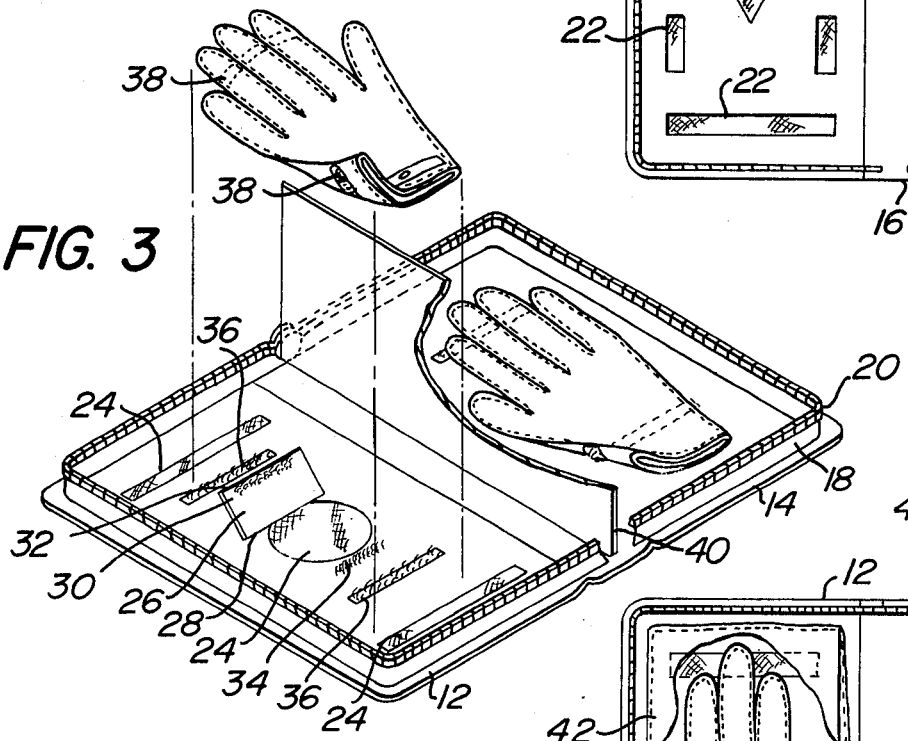
FIG. 4
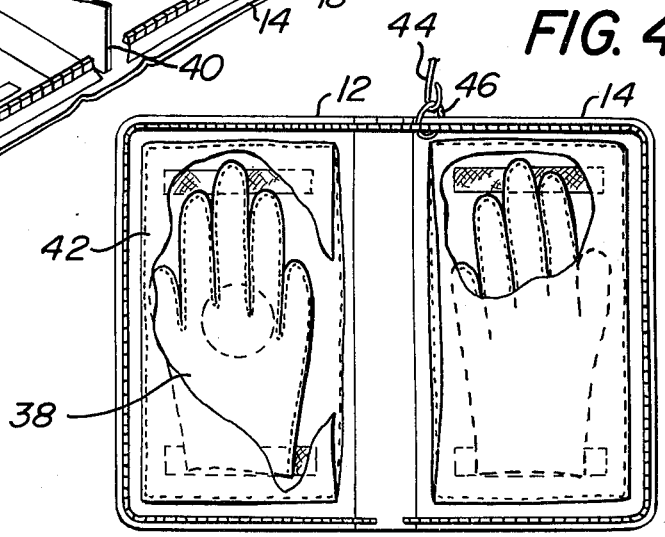
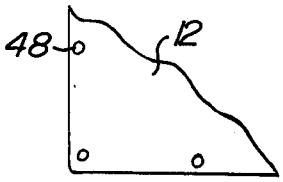
FIG. 5

GLOVE CONDITIONING CONTAINER

BACKGROUND OF THE INVENTION

Gloves, often uniquely designed, are used by many participants in sporting events. Gloves are necessary for such sports as handball and archery and recently, they have become more widely used in such sports as golf, tennis, horseback riding and baseball, i.e., used in baseball for batting and distinguished from fielder's mitts. Gloves also are widely used for outdoors activities such as fishing and gardening. For the above noted activities and other related activities, many different styles of gloves are used, most of which are constructed of animal skins or commonly used textiles.

A common problem which occurs regardless of whether the gloves are constructed from animal skins or other textiles is that the gloves when used are subjected to varying degrees of perspiration, and upon completion of the activity, the gloves are rarely afforded any conditioning care. Commonly, the gloves are left in an open environment where air will quickly dry them out with resulting damage to the gloves as oxidation occurs with the perspiration acting as a catalyst.

On the other hand, if the gloves are placed in a relatively air tight drawer or chest, the perspiration will not dry as desired and the growth of bacteria which will cause rotting and the like is stimulated.

SUMMARY OF THE INVENTION

Accordingly, it is an object of the subject invention to provide a container means which will permit effective conditioning for gloves which are used in activities wherein the gloves are subjected to perspiration of the wearer.

It is another object of the subject invention to provide a glove conditioning container which is designed to permit a controlled degree of air to reach the gloves while stored in the container to facilitate the conditioning process.

It is a related object of the subject invention to provide a glove conditioning container in which the gloves are pressed into a desired shape to prevent curling and the like during the time when controlled air is admitted to the glove storage area to facilitate glove conditioning.

It is still another object of the subject invention to provide a glove conditioning container which has effective means for separating the gloves during the drying and conditioning process.

It is yet one more object of the subject invention to provide a glove conditioning container wherein the gloves may be effectively closed within the container during the conditioning process although easily accessible for further use.

It is but one more object of the subject invention to provide a glove conditioning container which can be inexpensively manufactured, yet which nevertheless can substantially prolong the life of gloves to be contained therein.

It is one further object of the subject invention to provide a glove conditioning container which is aesthetically pleasing to the eye yet which is compact and can easily be carried by an athlete or other user.

In accordance with the above objects, the subject invention comprises a glove conditioning container featuring a foldable member and which includes means of securing gloves in predetermined positions within the foldable member. For example, pockets may be used which serve to hold the gloves in desired positions and simultaneously keep them from one another although a separator member may be used for this latter object. Appropriate closure means may be used such as Velcro strips coacting with one another, a zipper, or snaps. Controlled air means, such as vent holes, are utilized and these may be adjustable to permit varying degrees of air to reach the gloves with consideration given to the fact that different types of gloves, i.e., materials, dry better under different conditions.

The overall configuration of the container may be such that upon closing a foldable member with the closure means, the gloves are placed in compression to prevent curling and other disfigurement which may otherwise be associated with the drying and conditioning period.

BRIEF DESCRIPTION OF THE DRAWINGS

FIG. 1 is an isometric view of a glove conditioning container in its folded or closed position;

FIG. 2 is a plan elevational view of the glove conditioning container of FIG. 1 in an opened position;

FIG. 3 is an isometric view of a modified embodiment of the glove conditioning container of FIG. 1 wherein different types of vents are used in which additional features of the container are shown; FIG. 3A shows a modified vent;

FIG. 4 is a plan elevational view of a glove conditioning container similar to that shown in FIG. 3 only showing modified storage means together with attachment means;

FIG. 5 is a partial plan view showing a small portion of a glove conditioning container in which snap closure means are shown in place of the zipper closure means of embodiments in FIG. 1 - FIG. 4; and FIG. 6 is a partial isometric view of a small portion of a glove conditioning container in which Velcro closure means for the container is depicted.

DETAILED DESCRIPTION

With reference to FIG. 1, a first embodiment of the subject glove conditioning container 10 is shown. As best seen in FIG. 2, the glove conditioning container 10 has sides 12 and 14 with a foldable portion 16 disposed therebetween. Closure means 18 is shown stitched to sides 12 and 14 and terminates with zipper tracks 20 aligned with corresponding tracks on the opposing side portion.

The foldable container 10 with sides 12 and 14 and foldable portion 16 may be manufactured from animal skins, man-made textiles, materials of vegetable origin, or any other suitable material.

With further reference to FIGS. 1 and 2, vent or weep holes 22 are shown spaced at desirable positions throughout the surfaces of sides 12 and 14. The vent holes 22 permit the air to reach gloves stored within the container, yet the size, nature and positioning of the vent holes 22 control the amount of air that reaches the gloves. Any of a variety of gas permeable membranes may be used for the vent holes 22 or in the alternative, the holes may be completely uncovered.

With reference to FIG. 3, a modified system of vent holes 24 is shown. Additionally in FIG. 3, a vent hole closure means 26 is shown which comprises a cloth flap which is secured to side 12 by sewing or other means along flap end 28. Velcro or other fastening means 30 is positioned on each side of flap 26 so that the flap may be held in an open position as secured to coacting fastening means 32 or in a closed position as secured to coacting fastening means 34 positioned on the opposite side of vent hole 24. Thus, with the adjustability of vent holes, different types of gloves can be used in the same glove conditioning container with appropriate care being given to each type of glove regardless of whether it is cloth or animal skin. It is contemplated that directions will be given users of the glove conditioning containers.

Velcro strips 36 are shown positioned on 12 and may be used to help secure gloves 38. In the case of cloth gloves, the Velcro strips 36 may coact with the loops of the fabric to secure the gloves directly to the container sides, and in the case of animal skin gloves, Velcro strips 38 may be adhesively or otherwise attached to the gloves to be held against the container sides. A sepatator member 40 is shown which is one form of keeping the gloves apart so that they lie as flat as possible within the container when it is closed or folded.

With reference to FIG. 3A, a modified vent aperture 25 is disclosed. The semi-circular portion 27 is constructed of metal or plastic screen and permits the entry of air to the inside of the subject container. A cover 29 constructed of metal or plastic is rotatable by means of tab 31 so as to be adjustable to cover screen 27 as desired. It is to be understood that solid material is beneath cover 29 in the position that cover 29 is shown in FIG. 3A. Thus when cover 29 is rotated to its fullest extent, the entire screen 27 will be covered, thus shutting off the entry of all air. A track 33 extends around the perimeter of the screen portion as well as around the material beneath the cover 29 in the position that it is shown in FIG. 3A. A mating track 35 on cover 29 engages with track 33 so as to effectively seal the area which cover 29 covers when it is closed. The underside of cover 29, particularly along the straight portion may include Velcro-like material so that a semi-bond is formed with the screen below when the cover 29 is adjusted to cover portions of screen 27. This prohibits air from entering beneath the straight edges of cover 29 and through screen 27. Accordingly, it will be recognized that screen 27 may be partially or completely covered by cover 29.

The air adjustment means as discussed above enables precise control of air which reaches the inside of the subject container, particularly when only one air vent such as 25 is used. With certain gloves, it may be advantageous to admit more air during early periods of drying out after use, and subsequently decrease the air flow after the initial period is over. With such means, gloves may be stored over the winter, for example, in air tight containers, if such treatment is best for the gloves.

It is helpful to the conditioning and drying of the gloves 38 that they be subjected to compressive forces so that they may be permitted to dry in as flat a state as possible. Accordingly, curling, twisting and other types of disfiguring can be avoided. Accordingly, in preferred designs of the glove conditioning container, the dimensions are such that the distance from side 12 to side 14, when the two sides are folded, is such that the gloves will be subjected to compressive forces since a thickness of the gloves may be equal to or slightly greater than the distance between sides 12 and 14 when the container is empty and intermediate structure such as closure means 18 is in a relaxed state. Various ways of placing such compressive forces on the gloves 38 may be utilized within the scope of the subject invention, such as the design of foldable portion 16 may be of such small size that the distance between sides 12 and 14 must be very small when the sides are folded; additionally, the rigidity of sides 12 and 14 is a factor in the exertion of compressive forces against the gloves and stiffener elements may be utilized to promote such rigidity.

With reference to FIG. 4, sides 12 and 14 are shown having pocketlike members 42 secured to the sides 12 and 14 by stitching or other means. Velcro flaps accordingly in such an embodiment are unnecessary since the gloves are effectively held in position by the pocketlike members 42. In addition to securing gloves 38, the pocketlike members 42 serve as dividers and in such an embodiment, separator 40 of FIG. 3 is unnecessary.

A hook-like member 44 is shown secured by ring means 46 to the container and enables the container to be attached to equipment such as golf club bag (not shown). Thus the glove container may be looped to the golf bag strap, or in the alternative, in place of the hook-like member 44, Velcro on the outside of flaps 12 and 14 may be used to co-act with Velcro strips placed on the golf club bag.

With reference to FIG. 5, a small partial view of a portion of side 12 is shown with snaps 48 which would be positioned to co-act with mating snaps of side 14 of the glove conditioning container. Accordingly, in place of the zipper, the closure means of FIG. 5 comprises snap members.

With reference to FIG. 6, a small portion of side 12 is again shown, this time with a Velcro strip 50 which is positioned to co-act with a second Velcro strip on side 14. Accordingly, the Velcro is used as a closure means in place of the zipper or snaps of the earlier embodiments.

With further consideration being given to the foregoing embodiments, it will be appreciated that a number of different manufacturing techniques may be used. For example, the glove conditioning container may comprise a one-piece folded plastic member or in the alternative, different materials can be combined and stitched or otherwise sealed together. For example, sides 12 and 14 and multiple portion 16 may be integral and comprise a single piece of leather to which flaps 42 are stitched, adhesively attached or otherwise attached thereto.

When the glove conditioning container 10 is used for golf, it is compatible with other equipment previously disclosed in patent literature. For example, the Velcro-like material 12 of U.S. Pat. No. 3,532,344 which is located on parts of golf glove 5, may be helpful in securing the glove to Velcro strips 36 of the subject invention which are placed on sides 12 and 14. Additionally, in U.S. Pat. No. 3,128,812, a golf bag is disclosed having Velcro-like strips positioned to receive articles such as a golf club head cover which is shown in FIG. 2 of U.S. Pat. No. 3,128,812. It will be appreciated that the glove conditioning container 10 of the subject invention can conveniently be attached to the golf equipment bag of U.S. Pat. No. 3,128,812 in the same manner as the golf club head cover member.

The present invention may be embodied in other specific forms without departing from the spirit or essential attributes thereof and, accordingly, reference should be made to the appended claims, rather than to the foregoing specification as indicating the scope of the invention.

I claim:

1. A glove conditioning container comprising:

a foldable member;

closure means for securing sides of said foldable member together;

controlled ventilation means disposed to permit a controlled amount of air to reach the area formed within the sides of said foldable member when said member is in its folded position; and restraining means for a pair of gloves to permit said gloves to be positioned within the confines of said foldable member.

2. The glove conditioning container of claim 1 wherein said restraining means also serves as a means to seperate one glove from the other of said pair of gloves.

3. The glove conditioning container of claim 1 wherein said restraining means comprises pocketlike members disposed on the inward sides of said foldable member.

4. The glove conditioning container of claim 1 wherein said restraining means comprises Velcro strips designed to coact with said gloves, said Velcro strips being positioned on the inward sides of said foldable member.

5. The glove conditioning container of claim 1 wherein said ventilation means comprises vent holes positioned at locations on the sides of said foldable member.

6. The glove conditioning container of claim 5 wherein adjustable cover means is used in conjunction with said vent holes to further control the air admitted to the confines of said foldable member when in its folded position.

7. The glove conditioning container of claim 1 wherein said closure means comprises coacting Velcro strips disposed and aligned on the inwardly facing sides of said foldable member.

8. The glove conditioning container of claim 1 wherein said closure means comprises coacting snaps positioned on the inward sides of said foldable member.

9. The glove conditioning container of claim 1 wherein said closure means comprises zipper means disposed around the outer perimeter of said sides of said foldable member.

10. The glove conditioning container of claim 1 further including means for attaching said glove conditioning container to other elements.

11. The glove conditioning container of claim 1 wherein the dimensions of said foldable member permit said sides of said foldable member to exert compressive forces against gloves held within when said closure means holds the foldable member in a folded closed state.

* * * * *